US008511292B2

(12) United States Patent
Black et al.

(10) Patent No.: US 8,511,292 B2
(45) Date of Patent: Aug. 20, 2013

(54) SKEET THROWER

(75) Inventors: Thomas D. Black, Ovando, MT (US); Gerald B. Black, Milwaukie, OR (US)

(73) Assignee: WingOne LLC, Happy Valley, OR (US)

( * ) Notice: Subject to any disclaimer, the term of this patent is extended or adjusted under 35 U.S.C. 154(b) by 3 days.

(21) Appl. No.: 13/402,697

(22) Filed: Feb. 22, 2012

(65) Prior Publication Data

US 2012/0210989 A1 Aug. 23, 2012

Related U.S. Application Data

(60) Provisional application No. 61/463,764, filed on Feb. 23, 2011.

(51) Int. Cl.
*F41J 9/18* (2006.01)

(52) U.S. Cl.
USPC ..... 124/5

(58) Field of Classification Search
USPC ..... 124/5
See application file for complete search history.

(56) References Cited

U.S. PATENT DOCUMENTS

| | | | | |
|---|---|---|---|---|
| 663,090 | A | | 12/1900 | Pike et al. |
| 852,123 | A | | 4/1907 | Leggett |
| 934,093 | A | | 9/1909 | North |
| 1,164,609 | A | * | 12/1915 | Darton ..... 124/5 |
| 1,186,098 | A | | 6/1916 | Horst |
| 1,306,393 | A | | 6/1919 | Sibley |
| 1,700,880 | A | | 2/1929 | Camp |
| 1,865,173 | A | | 6/1932 | Dickerman |
| 2,122,984 | A | | 7/1938 | Loomis |
| 2,124,738 | A | | 7/1938 | Johnsen |
| D154,865 | S | | 8/1949 | Mellen |
| 2,493,245 | A | | 1/1950 | Hansen |
| 4,076,004 | A | | 2/1978 | Huelskamp |
| 4,233,952 | A | | 11/1980 | Perkins |
| 4,677,961 | A | | 7/1987 | Allison |
| 4,974,574 | A | * | 12/1990 | Cutlip ..... 124/5 |
| D622,804 | S | | 8/2010 | Minneman |

FOREIGN PATENT DOCUMENTS

| | | |
|---|---|---|
| WO | WO 02/23117 | 3/2002 |

* cited by examiner

*Primary Examiner* — John Ricci
(74) *Attorney, Agent, or Firm* — Miller Nash LLP

(57) ABSTRACT

The present invention addresses problems not resolved by conventional hand-held clay target throwers by providing a clay target throwing device comprising two unique main components that, both separately and upon combination, provide for a significantly improved hand-held clay target thrower device. The first main component is a unitary rear-loading flexible wire headend. The second main component is a specially formed handle including a self-cocking block component and an impact backstop structure. Together the combined flexible wire headend and handle provide an easy-to-use, efficient, effective, comfortable, and weather-resistant hand-held self-cocking and controlled release clay target throwing unit.

15 Claims, 9 Drawing Sheets

SKEET THROWER

RELATED APPLICATIONS

This application claims priority under 35 U.S.C. §119(e) to U.S. Provisional Patent Application Ser. No. 61/463,764, filed 23 Feb. 2011.

BACKGROUND OF THE INVENTION

1. Field of the Invention

The present invention relates to the field of hand-held clay target throwers and, specifically, to a clay target thrower comprising two main components that are each unique unto themselves and that both separately and upon combination, provide for a significantly improved hand-held clay target thrower system. The first main component is a unitary rear-loading flexible wire headend. The second component is a specially formed handle including a self-cocking block component and an impact structure to assist the comfortable, efficient, and effective throwing and launch of a clay target.

2. Description of Related Art

Hand-held clay target throwers have been in use for well over a century, such that the prior art illustrates an on-going interest in developing and perfecting such clay target throwers. These prior art devices have taken many forms, but have in common a means for holding a clay target until a sufficient propelling force is applied to launch the clay target.

One conventional embodiment of a hand-held clay target thrower is described in U.S. Pat. No. 4,076,004 to Huelskamp. This device is a front-loading hand-held thrower for clay pigeons that is formed of a single piece of resilient plastic material. The headend portion of the device has arms with flanges which encircle the pigeon, engaging it on its outermost circumference. It is said that this device has no separately moving parts. The resilient plastic material forming the entirety of the device includes a flexible neck and arms that bend under pressure to release and launch a clay pigeon.

Many hand-held clay target throwers comprise multiple components, including a front-loading headend, a spring actuated launch mechanism, a handle, and other constituents which needlessly complicate manufacture and use of the devices. See e.g., U.S. Pat. No. 1,700,880 to Camp and U.S. Pat. No. 1,865,173 to Dickerman. Other clay target throwers require a multitude of components such as an additional pressure-releasable means to hold the clay target thrower in a cocked position prior to launch, see e.g., U.S. Pat. No. 4,233,952 to Perkins, or a spring to hold the clay target on the device prior to launch, see e.g., U.S. Pat. No. 934,093 to North.

U.S. Pat. No. 2,124,738 to Johnsen discloses a front-loading or side-loading wire headend and requires the use of a single continuous piece of metal to construct the entirety of the clay target throwing device to achieve a purported extraordinary simplicity arising from the complete lack of pivoting parts. U.S. Pat. No. 663,090 to Pike et al. discloses the use of a front-loading wire clip for use with a handle, wherein the wire component is bent to form a loop or loops to attach to the handle and act as a pivot point, such that the wire clip is capable of being turned to any desired angle relative to the handle or may be rigidly secured.

Accordingly, the prior art provides several examples of sub-optimal hand-held clay target throwers which, among other things: require too many components which frustrate their manufacture and use; eliminate inclusion of a pivot point which results in a loss of beneficial momentum to the clay target upon launch; require loading techniques that disrupt the smooth operation and function of the device and/or promote clay target or clay pigeon breakage, thus, increasing the cost of clay target shooting and decreasing user enjoyment; failing to produce variable flight patterns; and that make their productive and recreational use unnecessarily difficult by not including reliable or consistent self-cocking block and release or launch mechanisms.

BRIEF SUMMARY OF THE INVENTION

The present invention addresses problems not resolved by conventional hand-held clay target throwers by providing a clay target throwing device comprising two unique main components that, both separately and upon combination, provide for a significantly improved hand-held clay target thrower system. The first main component is a unitary rear-loading flexible wire headend. The second main component is a specially formed handle including a self-cocking block component and an impact backstop structure. Together the combined flexible wire headend and handle provide an easy-to-use, efficient, effective, comfortable, and weather-resistant hand-held self-cocking and controlled release clay target throwing unit. The present invention advantageously also permits a single user to both throw and shoot launched clay targets. The present invention is capable of throwing a clay target over 100 yards. The speed of the throw, depending on the skill of the thrower, is very fast and is directional. The present invention may be readily adapted for use by right-handed or left-handed throwers. The present invention gives a new dimension to the art of manual clay target throwing.

The Headend

The first main component is a unitary rear-loading flexible wire headend that is not only easier and faster to load but that also reduces clay target breakage. The flexible wire headend may comprise various metals and may be heat treated to give properties of flexibility and memory. For example, spring steel, piano wire, stainless steel, and any heat treated, galvanized, or zinc coated steel having sufficient flexibility and memory can be used. The flexible wire headend must be sufficiently stiff to accommodate the secure loading and throwing of the clay targets, but flexible enough to deflect under sufficient throwing force to allow a loaded clay target to launch from the clay target thrower.

In a preferred embodiment, a strong gauge wire, such as 3/16 inch steel rod, is used to provide proper bending. The flexible wire may comprise various diameters ranging between about 0.10 inches and about 0.50 inches, more preferably between about 0.11 inches and about 0.3 inches, still more preferably, between about 0.125 inches (1/8 inch) and about 0.250 inches (1/4 inch) and, most preferably, at or between about 0.160 inches (4/25 inch) and about 0.192 inches (about 1/5 an inch). The headend wire is preferably treated to prevent rusting, for example, by the inclusion of zinc or by undergoing galvanization. It is also contemplated that the headend may be plated for aesthetic purposes, for example, to create a silver or gold appearance.

The flexible wire headend secures a loaded clay target by exerting flex pressure from the wire onto the loaded clay target. The top surface of the clay target is held by pressure exerted from the headend wire onto the shoulder of the clay target.

The flexible wire headend is uniquely adapted to permit rear-loading of a clay target. Advantageously, the user of the present invention can load the clay target into the clay target thrower while holding the device in the same position used to throw the clay target. That is, the user is provided with a means of direct rear-loading access that permits the user to maintain their grip on the handle in a throwing position while also accomplishing the easy and rapid rear-loading of a clay target. Rear-loading of the invention can also be referred to as top and rear-loading of the invention because the headend is oriented with its top-side facing upwards while a clay target is top and rear-loaded. Accordingly, the present invention advantageously does not require that the user turn the entire device around or on its side to accomplish loading of the clay target. Accordingly, a user of the present invention can rapidly load and launch a clay target. The present invention can be loaded and launched as fast as the shooter shoots. For example, the load and launch of three clay pigeons in three seconds can be accomplished using the present invention. In another example, an experienced thrower can load and throw each clay target in a series of several clay targets in about one second per clay target. Given the convenient, efficient and rapid loading and clay target deployment provided by the present invention, it enables a single user to load, launch, and shoot a clay target without additional assistance.

The flexible wire headend includes an attachment point bend partially enclosing an open space for attachment to the handle by means of inserting a rivet, or a nut and bolt, or similar means, through the partially enclosed open space. This attachment point also provides a pivot point around which the flexible wire headend may turn to the extent that the attachment point bend and its handle attachment, including a self-cocking block and an impact backstop structure, permit. In a preferred embodiment, the attachment point permits a fixed and preferred rotation range of about 135 degrees between the impact backstop structure and the self-cocking block component, however, greater or smaller fixed rotational ranges ranging from about 165 degrees to about 30 degrees, or, more preferably, between about 150 degrees and 60 degrees, may be accomplished. In a preferred embodiment, the internal radius of the open space partially enclosed by the attachment point bend is about ¼ inch.

In a preferred embodiment, the flexible wire headend spatially occupies a first (upper) horizontal plane and a second (lower) horizontal plane, which are connected by two separate left and right vertical connection bends in the flexible wire headend and united by an attachment point bend located on the second horizontal plane. Each of the first and second horizontal planes provide at least two points of contact with a top and bottom surface of a loaded clay target, respectively, which are used to hold a loaded clay target in place prior to launch. The flexible wire headend in the first horizontal plane provides two points of contact with opposing sides of the shoulder on the top surface of a loaded clay target. By securing the loaded clay target at points along its shoulder as opposed to its edge, the headend wire of the present invention advantageously facilitates reduced clay target breakage since the clay target shoulder provides a stronger point of contact to secure the loaded clay target. The flexible wire headend in the second horizontal plane provides two points of contact which generally provide support to, and contact with the bottom surface of, a loaded clay target.

In a preferred embodiment, the flexible wire headend is generally triangular in shape, and is open on one side. The overall shape of the second (lower) horizontal plane may be referred to "V-shaped" and can have an internal angle between the two lines extending out from the common axis of the "V" of about 44 degrees. The outer extremities of the "V-shaped" second (lower) horizontal plane of the flexible wire headend give rise to the two separate left and right vertical connection bends that each extend vertically upward from the second (lower) horizontal plane and then fold straight back along a first (upper) horizontal plane towards the handle of the device. Optionally, at least one of the left and right vertical connection bends may flare out to the side as part of the vertical rise, as depicted in FIGS. 1 to 5, or such a flare out to the side may not be included.

In a preferred embodiment, the left and right extensions of the flexible wire headend folding back towards the handle of the device from the left and right vertical connection bends occupy the first (upper) horizontal plane. The left and right extensions occupying the first (upper) horizontal plane are straight and parallel in their respective horizontal plane to the wire lengths comprising the second (lower) horizontal plane. The left and right extensions are also angled outward and away (on their respective horizontal parallel plane) from the "V-shaped" second (lower) horizontal plane at an angle of about 22 degrees. Each of the left and right extensions occupying the first (upper) horizontal plane terminates by making a final loading bend at each end of the flexible wire headend that tilts upward and vertically away from both the first (upper) and second (lower) horizontal planes at an angle of about 35 degrees.

In a preferred embodiment, the flexible wire headend is about 6 inches long, as measured from the attachment point bend on the second (lower) horizontal plane and the two separate left and right vertical connection bends located on opposing ends of the "V-shaped" flexible wire headend (including about 0.6 inches in length to account for the formation of the attachment point bend); the maximum width of the flexible wire headend is about 5.1 inches (including one flare out to the side on one of the left and right vertical connection bends); the left and right vertical connection bends are about 0.9 inches high; and each of the loading bends contributes to an overall total vertical height of the flexible wire headend of about 1 inch.

In another embodiment, the flexible wire headend is about 6 inches long, as measured from the attachment point bend on the second (lower) horizontal plane and the two separate left and right vertical connection bends located on opposing ends of the "V-shaped" flexible wire headend (including about 2.0 to about 3.0 inches in length to account for the formation of the attachment point bend); the maximum width of the flexible wire headend is about 4.0 inches (not including one flare out to the side on one of the left and right vertical connection bends); the left and right vertical connection bends are about 0.8 inches high; and each of the loading bends contributes to an overall total vertical height of the flexible wire headend of about 1 inch. The flexible wire headend may also include an off-set bend that is about 0.19 inches high to further facilitate easy rear-loading of the headend by moving the headend away from any obstruction imposed by the handle. The overall shape of the second (lower) horizontal plane may be referred to "V-shaped" and can have an internal angle between the two lines extending out from the common axis of the "V" of greater than about 44 degrees, for example, between about 50 and about 110 degrees, more preferably between about 75 and about 90 degrees, and most preferably about 88 degrees.

In a preferred embodiment, when assembled together the handle and the flexible headend have a horizontal profile that is about 1¼ inch to about 1½ inch in height.

In its preferred embodiment, the headend system accommodates a variety of clay targets, or clay pigeons, which contributes to the versatility of the present invention. For example, it can be used to throw "standard" size clay targets. It may also be used to throw "nested" clay targets, which launches a standard clay target with a smaller clay target inside of it, a smaller "midi" placed into the back of the "standard" clay pigeon, a hard density "rabbit," etc. Additionally, a three clay target nested set may all launch with a preferred embodiment of this invention. The headend system is, optionally, also computer designed for flexibility in using different configurations of the clay target.

While the above description defines a preferred embodiment, the inventors note that the flexible wire headend can vary in both shape and size, and to accommodate clay targets of varying size, in accordance with the general principles of this invention. That is, as new types of clay targets, pigeons, birds, or other clays are developed, the flexible wire headend can be modified or molded to accommodate the different targets. Such modification may involve the depression or the expansion of the flexible wire headend to accommodate the newly sized clay target.

With regard to the first (upper) horizontal plane of the flexible wire headend, in a particularly preferred embodiment, the unique headend configuration of the present invention also minimizes superfluous shoulder contact with the top surface of the clay target, thus further reducing unnecessary and disruptive friction between the clay target and the device upon clay target launch and also reducing clay target breakage. Specifically, the headend configuration provides two opposing straight flexible wire points of contact with the curved clay target shoulder on the top surface of the loaded clay target, as opposed to curved or otherwise continuous points of contact around, or that "hug," the clay target shoulder.

The headend component preferably includes a fixed or stationary grommet that mounts on either one of the left or right vertical connection bends. The grommet is preferably made of rubber, but may also comprise other similarly suitable materials. The, preferably, fixed and stationary rubber grommet serves multiple purposes. Upon loading, the rubber grommet provides a stopping point such that the user loads a clay target until it comes into contact with the rubber grommet. Upon launch, contact of the clay target against the rubber grommet initiates and facilitates the rotational spin of the clay target. Advantageously, the rubber grommet may be used on either of the left or right vertical connection bends to accommodate usage of the present invention by either left-handed or right-handed throwers. A non-fixed or rolling rubber grommet is not contemplated for use with the present invention because it would not generate the desired clay target rotation upon clay target launch.

In another embodiment, the flexible wire headend can be modified to include more bends to accommodate multiple clay targets. For example, three bends could be included to accommodate nested clay pigeons, batue, and large and small rabbit targets.

In another embodiment, the flexible wire headend can be bent with an off-set to further facilitate easy loading by the reduction or elimination of the handle from being an obstruction.

In yet another embodiment, the present invention can include a flexible wire headend adapted for use with various projectiles, including, but not limited to, tennis balls, baseballs, flying disks, etc.

The Handle

The second component is a specially formed handle including a self-cocking block component and an impact structure to assist the comfortable, efficient, consistent, reliable, controlled, and effective throwing and launch of a clay target. Specifically, the present invention provides an ergonomic handle that is not only comfortable to use, but also permits the user to manipulate the clay target thrower to produce multiple flight patterns.

The preferred embodiment includes a round ergonomic handle, but the handle may comprise a variety of shapes and sizes. In an especially preferred embodiment, the handle is round and tapered, with the widest part of the handle forming the end of the handle. The handle of the present invention permits the user to swing the clay target thrower closer to the ground as the thrower can grasp the handle closer to the headend.

The handle can comprise polymeric materials, including but not limited to, a copolymer of acrylonitrile, butadiene, and styrene (an ABS plastic), polyvinyl chloride (PVC), co-polyester, aluminum, steel, etc., or suitable combinations thereof. In one embodiment, the handle is made from a formulation of polymers that provide added strength and flexibility. This handle was engineered to give maximum form, fit, and function required by its design. The handle is preferably injection molded and may comprise clam shell injection molding. The handle can be formed of two components, for example, as depicted in FIGS. 6 and 7. These two components are preferably secured together by an adhesive, such as glue or another similarly suitable material.

The handle length can vary in size between about 10 inches and about 42 inches, and its diameter can vary from about 1 inch to about 2 inches, and is preferably about 1.2 inches. In a particularly preferred embodiment, the handle length is about 16½ inches and the handle diameter is about 1⅛ inch to about 1¼ inch at its end.

In an alternative embodiment, the handle of the present invention is made out of conduit size metal and is about ½ inch to about ⅝ inches in diameter.

Separate parts of the handle and wire headend system come together to create a pivot point to allow for greater speed and longer distances of launched clay targets. In one embodiment, the headend component and the handle component are joined together using a bolt and nut, or rivet, or a similar attachment means, and tightened to specification. In a preferred embodiment, the attachment means used to form the pivot point of the present invention does not also function to secure the two separate handle components, which are, instead, adhered together by an adhesive.

The pivot point may be used to activate the locking of a loaded clay target, cocking, and launching of a clay target within and from the present invention. The cocking motion is automatic with the back swing and requires no separate operation. Specifically, the handle of the present invention facilitates automatic cocking by inclusion of a pivot rotation block component that stops the continued rotation of the headend upon swinging the clay target thrower backwards prior to clay target launch. The pivot rotation block component may be integrally formed as part of the handle itself, or may comprise a separate component, such as a bolt or rivet, or other suitable means.

The handle also includes a backstop structure on one end, or its tip, that distributes impact force over a broad area of the handle. This distribution of impact force prevents material fatigue of both the handle and the flexible wire headend at the impact surfaces to give the clay target thrower a long life. When the wire headend system impacts the handle's impact backstop structure at the end of the throw, the force and momentum of the throw transfers to the clay target to launch the clay target from the headend of the clay target thrower outward from the headend of the clay target thrower. The combined flexible wire headend and handle also provide an assembly that is comfortable to use as the clay target thrower includes an impact backstop structure on the handle that stops the forward motion of the headend to activate clay target launch, that also absorbs and distributes and disperses the impact force of the clay target launch throughout the handle. The backstop structure may be integrally formed as part of the handle itself, or may comprise a separate component or components, such as a nut and bolt, or rivet, or other suitable means. In one preferred embodiment, the impact backstop structure comprises a nut and bolt or rivet. In another preferred embodiment, the impact backstop structure comprises a bolt or rivet together with material integrally formed as part of the handle, which together serves to absorb the impact and distribute the impact force throughout the handle.

The handle may include features to aid the user's grip and for non-slip functionality, such as cross-hatching, dipping in a substance to improve the tactile feel and/or grip (such as rubber or a similar substance), a knob on the handle, etc.

In a preferred embodiment, the handle is a round ergonomic handle that allows for a number of different clay target throws and is, optionally, computer designed. The round handle fits specifications required to throw a clay target in various patterns. That is, the round handle is easily gripped at various locations and readily accommodates unique angles of launch to give the thrower the ability to control the angles, direction, and speed of a thrown clay target. For example, the launched clay pigeon can be maneuvered left, right, straight up, left sharp left 90 degrees throw and right sharp right 90 degrees, up and back at the thrower, low and straight away, down and high speed sail, to provide a soft floater of variable speed, and others.

The handle may optionally include a switch for turning an integrated, attached, or otherwise associated light-emitting diode (LED) light on and off, may include color variations, such as green with a fluorescent additive, may include a designated surface space for a logo, and may be adapted to include a lanyard for hanging the clay target thrower from the user's wrist when it is not in use.

The handle may also be hollow and may be adapted to accommodate storage of various items including, but not limited to, batteries with a light-emitting diode (LED) bulb to light or activate a glow-in-the-dark paint on a clay target for night shooting and/or personal items, such as a cigar, fire starter, beverage, etc.

In one embodiment, the handle includes an integrated LED light to be used with light activated painted clay targets. That is, the clay target is painted with glowing type paint. Paint might be lighted before launch. In such an embodiment, batteries in the handle would be attached to an LED light at the handle's end to generate the light source through a 16 light gauge wire (or a 16 light gauge to a 20 light gauge wire), or whatever wire is chosen. This unique embodiment allows for night throwing activities involving specially treated or painted clay targets.

In an alternative embodiment, the handle may include an additional pivot point to provide the user with another action for greater throwing power to achieve greater distances and/or control.

Based on the disclosure provided herein, the inventors aim to bring to market a new concept to the hand-held clay target throwing devices category. A handle product, or component, preferably utilizes polymers and a special flexible wire headend system configuration product, or component. This new device and system allows for throwing various patterns and types of clay targets. The exclusive rear-loading flexible wire headend design is unique and gives speed in throwing. It also reduces the clay target problem of breakage while loading. This unique headend design also accommodates multiple types and configurations of clay targets, such as a single full-sized clay target, and nested, ground roll, and mini clay targets. The handle and the headend products, or components, may be high tech in design and provide ergonomic function.

Using the Present Invention

The operational technique for using the present invention is similar to throwing a football—slightly side arm. The stance is very similar to that of a quarterback preparing for a long throw with his feet slightly spread. The forward motion and release is nearly the same as the quarterback. The user loads the clay target into the headend load rails from the rear. That is, the user holds the clay target thrower and inserts a clay target into the back of the wire form from the handle. The clay target is pushed forward until it comes in contact with, or is seated against, the rubber grommet. The user does not need to push hard or push further than the rubber stop. The user swings the clay pigeon thrower back behind them (about 45 degrees back from their hip) to initiate the throw.

Upon extending the throwing arm backwards, the clay target thrower should be kept at a level that is about waist high. This backward movement "cocks" the thrower automatically due to the rotational pivot of the headend against the rotation block component. When "cocked," the headend preferably will be about 135 degrees to the handle. The user then starts a forward movement, for example, in a slightly side arm throwing position, extending their arm from behind to a position in front of them, resulting in a rotation of the position of the clay target thrower handle of about 180 degrees. As the thrower's arm moves forward, the elbow is kept close to the hip and waist, and after rotating through a range of about 180 degrees, the thrower stops their forward motion, causing the gathered momentum to allow the flexible wire headend form to "snap" forward rotating the loaded clay target around the pivot point on the handle about 135 degrees to contact the impact backstop structure which, upon contact exerts sufficient pressure to release and launch the clay target from the holding pressure exerted by the flexible wire headend. Accordingly, the rotational force of the user's 180 degree throw is bolstered by the additional 135 degrees of rotation provided by the pivot mechanism of the present invention to produce a more powerful throw.

As the clay target hits the, preferably, fixed or stationary rubber grommet it starts to spin and releases from the loading bend extensions. The release point normally is about 180 degrees from the back swing. The impact backstop structure automatically stops the headend swing as the thrower stops their arm after the about 180 degree launch swing. Depending on the user's technique, a variety of throws can be generated. As the clay pigeon races out very fast, a distance of over 100 yards can be achieved. Variations of holding the handle results in being able to launch some challenging targets, and use of a preferred round handle enables the thrower to hold the handle at any angle relative to the headend component, resulting in endless throwing possibilities. The user simply must stop the forward motion of their throw to overcome the flex tension within the flexible wire headend and launch a clay target from the clay target thrower. Forward motion launches the clay target in any angle or elevation. Moving the position of the hand on the handle can create various types of throwing angles. Straight away low, high, or in between gives you different angles and direction. Nested clays will drop out at 25-30 yards and high speed ground huggers will sail over 100 yards.

BRIEF DESCRIPTION OF THE SEVERAL VIEWS OF THE DRAWINGS

The accompanying Figures, which are incorporated in and constitute a part of this specification, illustrate various exemplary embodiments.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structures.

Figure 1:
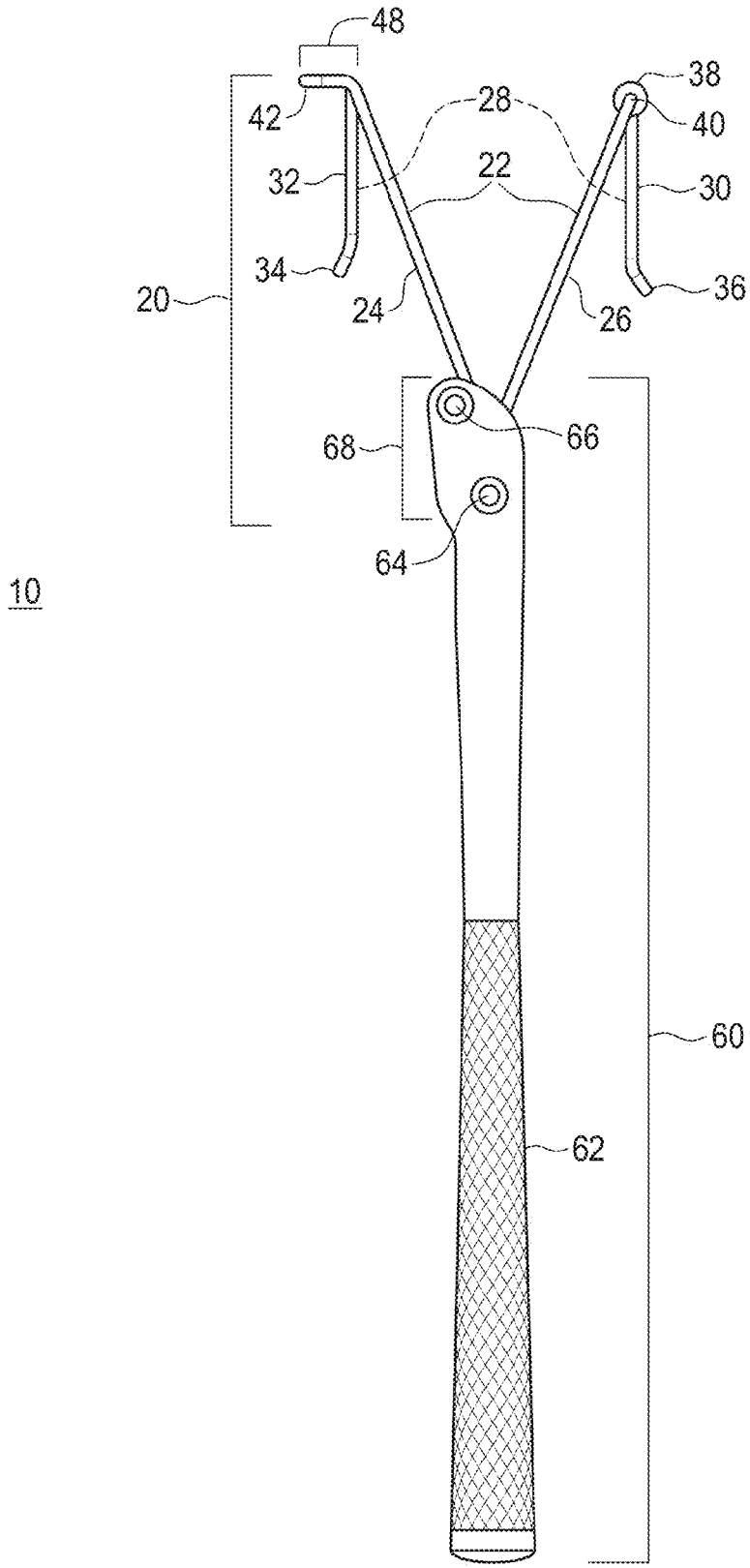
FIG. 1 provides a bottom elevation view of a clay target thrower according to the present invention.

FIG. 1 provides a bottom elevation view of a clay target thrower 10 according to the present invention. Clay target thrower 10 generally comprises a flexible wire headend 20 and a handle 60. As depicted, flexible wire headend 20 includes a first (upper) horizontal plane 28 and a second (lower) horizontal plane 22. The support wire lengths 24 and 26 of the second horizontal plane 22 provide contact points to support the loaded clay target. Loading wire lengths 30 and 32 of the first horizontal plane 28 provide contact points to hold the loaded clay target at the shoulder. Loading bend extensions 34 and 36 tilt upward and vertically away from both the first (upper) and second (lower) horizontal planes at an angle of about 35 degrees and aid loading of the clay target thrower. Rubber grommet 38 is depicted on the left vertical connection bend 40 (vertical depth not visible) that extends vertically upward from the second (lower) horizontal plane and then folds straight back towards the handle of the device. As depicted, vertical connection bend 42 comprises a flare out to the side 48. In an alternative embodiment, rubber grommet 38 can be placed on the right vertical connection bend 42 (vertical depth not visible) that extends vertically upward from the second (lower) horizontal plane and then folds straight back towards the handle of the device.

Handle 60 is depicted as being generally circular or round in its circumference and bearing a cross-hatch grip 62 on a portion of its surface. Handle 60 is also depicted with a pivot connection means (such as a bolt and nut, or rivet) 64 inserted through the attachment point bend (not visible) of headend 20. Handle 60 further depicts the inclusion of a separate handle contact means (such as a bolt and nut, or rivet) 66 that serves as part of the handle impact backstop structure 68.

Figure 2:
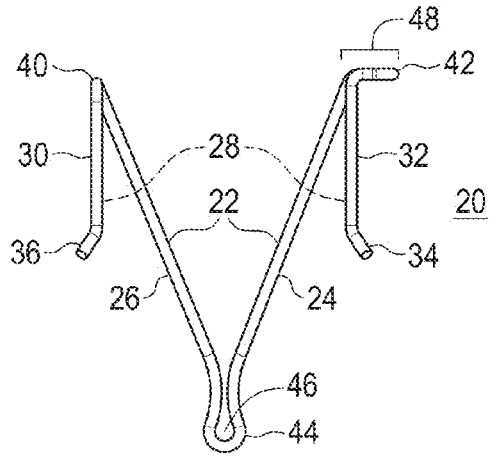
FIG. 2 provides a top elevation view of a flexible wire headend according to the present invention.

FIG. 2 provides a top elevation view of a flexible wire headend 20 according to the present invention. As depicted, flexible wire headend 20 includes a first (upper) horizontal plane 28 and a second (lower) horizontal plane 22. The support wire lengths 24 and 26 of the second horizontal plane 22 provide contact points to support the loaded clay target. Loading wire lengths 30 and 32 of the first horizontal plane 28 provide contact points to hold the loaded clay target at the shoulder. Left and right vertical connection bends 40 and 42 (vertical depth not depicted) extend vertically upward from the second (lower) horizontal plane and then fold straight back towards the handle (not depicted) along the first (upper) horizontal plane 28 of the device. As depicted, vertical connection bend 42 comprises a flare out to the side 48. Loading bend extensions 34 and 36 tilt upward and vertically away from both the first (upper) and second (lower) horizontal planes at an angle of about 35 degrees and aid loading of the clay target thrower. Attachment point bend 44 is depicted as defining an end opening space 46.

Figure 3:
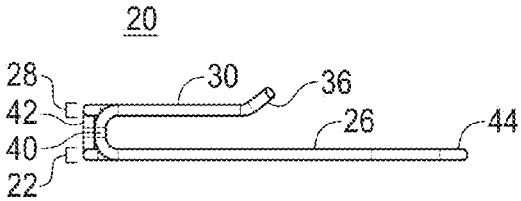
FIG. 3 provides a side elevation view of a flexible wire headend along a horizontal plane according to the present invention.

FIG. 3 provides a side elevation view of a flexible wire headend 20 along a horizontal plane according to the present invention. As depicted, flexible wire headend 20 includes a first (upper) horizontal plane 28 and a second (lower) horizontal plane 22. The support wire lengths 24 (not visible) and 26 of the second horizontal plane 22 provide contact points to support the loaded clay target. Loading wire lengths 30 and 32 (not visible) of the first horizontal plane 28 provide contact points to hold the loaded clay target at the shoulder. Left and right vertical connection bends 40 and 42 extend vertically upward from the second (lower) horizontal plane and then fold straight back towards the handle (not depicted) along the first (upper) horizontal plane 28 of the device. Loading bend extensions 34 (not visible) and 36 tilt upward and vertically away from both the first (upper) and second (lower) horizontal planes at an angle of about 35 degrees and aid loading of the clay target thrower. Attachment point bend 44 is depicted.

Figure 4:
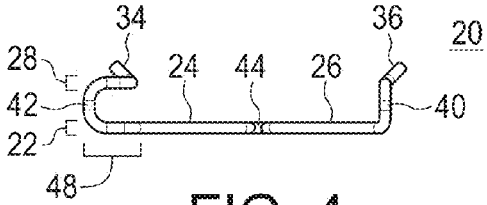
FIG. 4 provides a front-end elevation view of a flexible wire headend along a vertical plane according to the present invention.

FIG. 4 provides a side elevation view of a flexible wire headend 20 along a vertical plane according to the present invention. As depicted, flexible wire headend 20 includes a first (upper) horizontal plane 28 and a second (lower) horizontal plane 22. The support wire lengths 24 and 26 of the second horizontal plane 22 provide contact points to support the loaded clay target. Loading wire lengths 30 and 32 (neither visible) of the first horizontal plane 28 provide contact points to hold the loaded clay target at the shoulder. Left and right vertical connection bends 40 and 42 extend vertically upward from the second (lower) horizontal plane 22 and then fold straight back towards the handle (not depicted) along the first (upper) horizontal plane 28 of the device. As depicted, vertical connection bend 42 comprises a flare out to the side 48. Loading bend extensions 34 and 36 tilt upward and vertically away from both the first (upper) and second (lower) horizontal planes at an angle of about 35 degrees and aid loading of the clay target thrower. Attachment point bend 44 is depicted.

Figure 5:
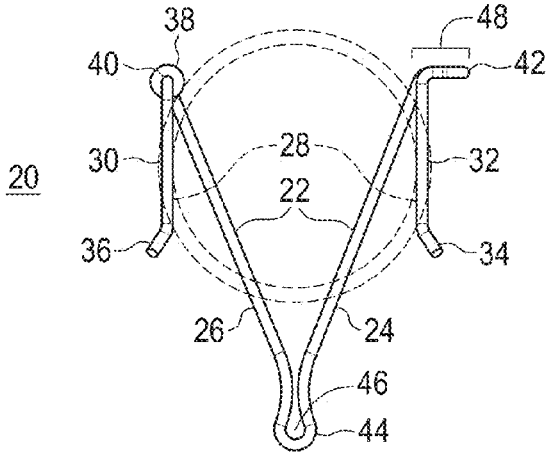
FIG. 5 provides a top elevation view of a flexible wire headend including a fixed or stationary rubber grommet and additionally indicating the fit of an exemplary clay pigeon according to the present invention.

FIG. 5 provides a top elevation view of a flexible wire headend 20 including a rubber grommet and additionally indicating the fit of an exemplary clay pigeon in broken line according to the present invention. As depicted, flexible wire headend 20 includes a first (upper) horizontal plane 28 and a second (lower) horizontal plane 22. The support wire lengths 24 and 26 of the second horizontal plane 22 provide contact points to support the loaded clay target. Loading wire lengths 30 and 32 of the first horizontal plane 28 provide contact points to hold the loaded clay target at the shoulder. Loading bend extensions 34 and 36 tilt upward and vertically away from both the first (upper) and second (lower) horizontal planes at an angle of about 35 degrees and aid loading of the clay target thrower. Rubber grommet 38 is depicted on the left vertical connection bend 40 (vertical depth not visible) that extends vertically upward from the second (lower) horizontal plane and then folds straight back towards the handle of the device. In an alternative embodiment, rubber grommet 38 can be placed on the right vertical connection bend 42 (vertical depth not visible) that extends vertically upward from the second (lower) horizontal plane and then folds straight back towards the handle of the device. As depicted, vertical connection bend 42 comprises a flare out to the side 48.

Figure 6:
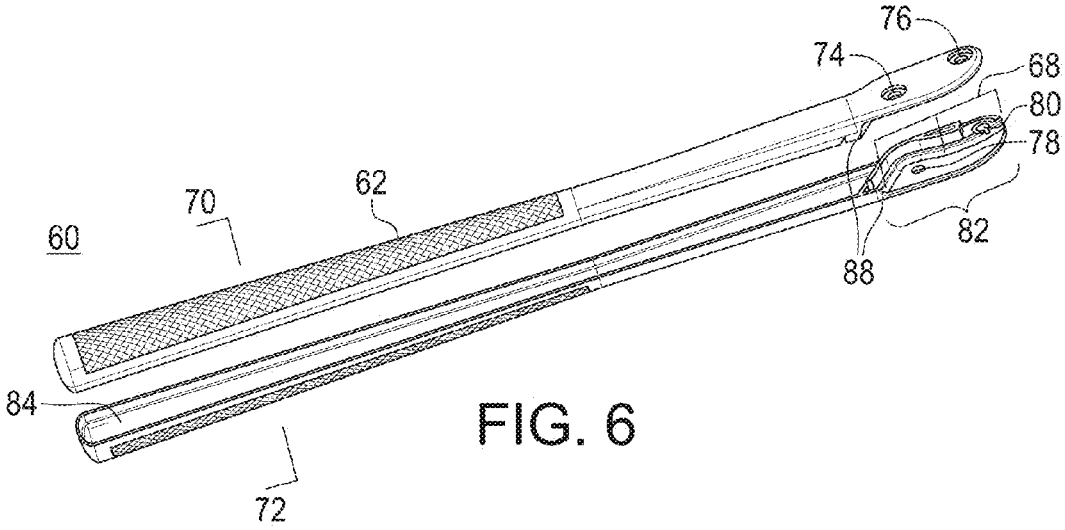
FIG. 6 provides an exploded perspective view of a handle according to the present invention.

FIG. 6 provides an exploded perspective view of a handle 60 according to the present invention. As depicted, the handle is shown to comprise two parts, a first part 70 and a second part 72. The handle 60 includes on its external surfaces a cross-hatch grip 62, and has a hollow interior 84. The first part 70 of handle 60 includes two holes 74 and 76 to provide access to connection means (such as a bolt and nut, or rivet) 64 (not depicted) to unite the first part 70 of handle 60 to the second part 72 of handle 60 and to attach a contact means (such as a bolt and nut, or rivet) 66 (not depicted). The second part 72 of handle 60 include two holes 78 and 80 to provide access to connection means (such as a bolt and nut, or rivet) 64 to unite the second part 72 of handle 60 to the first part 70 of handle 60 and to attach a contact means (such as a bolt and nut, or rivet) 66. The first part 70 and the second part 72 of handle 60 also include an open interior pivot space 82. The hole 74 of the first part 70 of handle 60 and the hole 78 of the second part 72 of handle 60 are located within the space defining open interior pivot space 82. An impact backstop structure 68 is shown to define the interior boundary of the open interior pivot space 82, with its upper portion contacting the exterior of the contact means (such as a bolt and nut, or rivet) 66 assembly. The cocking block 88 is shown to comprise the lower edge of the space defined by the open interior pivot space 82.

Figure 7:
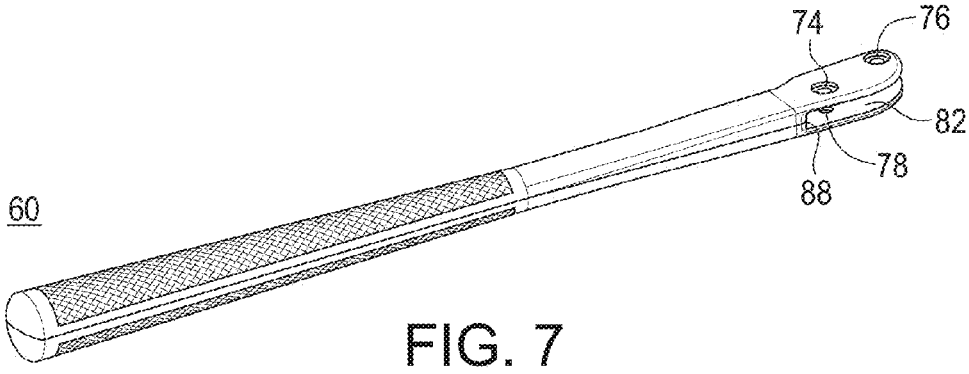
FIG. 7 provides an assembled perspective view of a handle according to the present invention.

FIG. 7 provides an assembled perspective view of handle 60 according to the present invention and as detailed above in connection with FIG. 6. The cocking block 88 is shown to comprise the lower edge of the space defined by the open interior pivot space 82.

Figure 8:
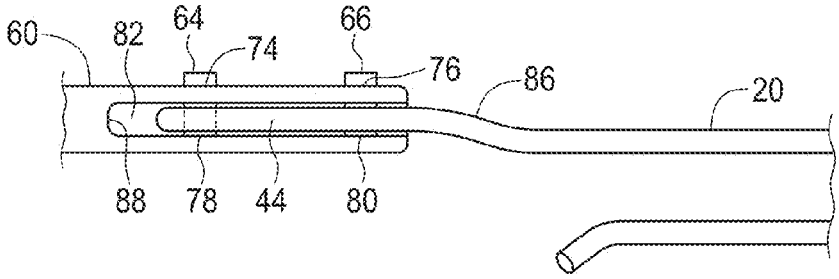
FIG. 8 provides a side elevation view and close up of the connection between the headend and the handle according to the present invention as generally shown in FIGS. 1-7.

FIG. 8 provides a side elevation view and close up of the connection between the headend 20 and the handle 60 according to the present invention, as generally shown in FIGS. 1-7. The attachment point bend 44 of headend 20 is shown to fit within the open interior pivot space 82 of handle 60. The first part 70 and second part 72 of handle 60 are shown as assembled. Specifically, a connection means (such as a bolt and nut, or rivet) 64 is shown to be inserted through hole 74 of the first part 70 of handle 60, through the end opening space provided by the attachment point bend of headend 20, and into hole 78 of the second part 72 of handle 60. A separate contact means (such as a bolt and nut, or rivet) 66 is shown to be inserted through hole 76 of the first part 70 of handle 60 and into hole 80 of the second part 72 of handle 60. The contact means 66 does not occupy the open interior pivot space 82 of handle 60, and the impact backstop structure defines the interior boundary of the open interior pivot space 82 that includes an outer surface of contact means 66. Off-set bend 86 of headend wire 20 depicts an optional embodiment of headend 20 which includes off-set bend 86 to further facilitate easy rear-loading of the headend 20 by moving the headend 20 away from any obstruction imposed by the handle 60. The cocking block 88 is shown to comprise the lower edge of the space defined by the open interior pivot space 82.

Figure 9:
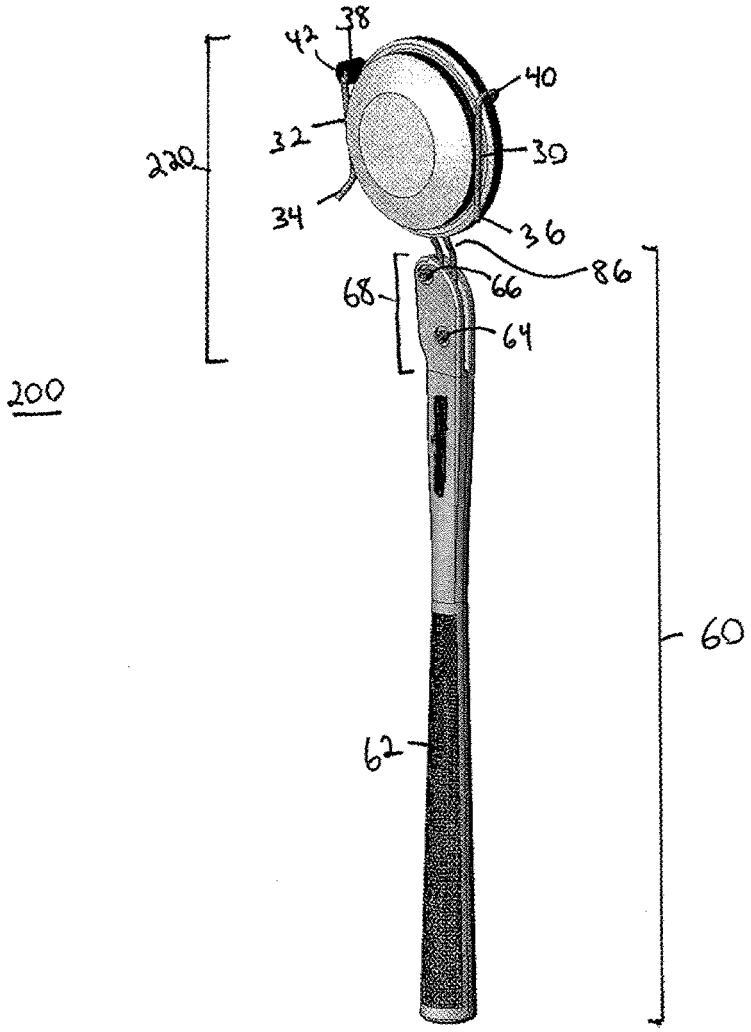
FIG. 9 provides a top perspective view of another embodiment of the present invention.

FIG. 9 provides a top perspective view of a clay target thrower 200 according to the present invention. Clay target thrower 200 is similar to the device depicted in FIGS. 1-8 and the descriptions for the shared reference numbers provided for FIGS. 1-8 are incorporated herein by reference. Here, however, the flexible wire headend 220 differs in that it does not include the flare out to the side 48 depicted on vertical connection bend 42 in FIGS. 1-5, and the wire comprising attachment point bend 44 (not depicted) and the support wire of the second horizontal plane 22 (not depicted) differ as shown in FIGS. 10-12.

Figure 10:
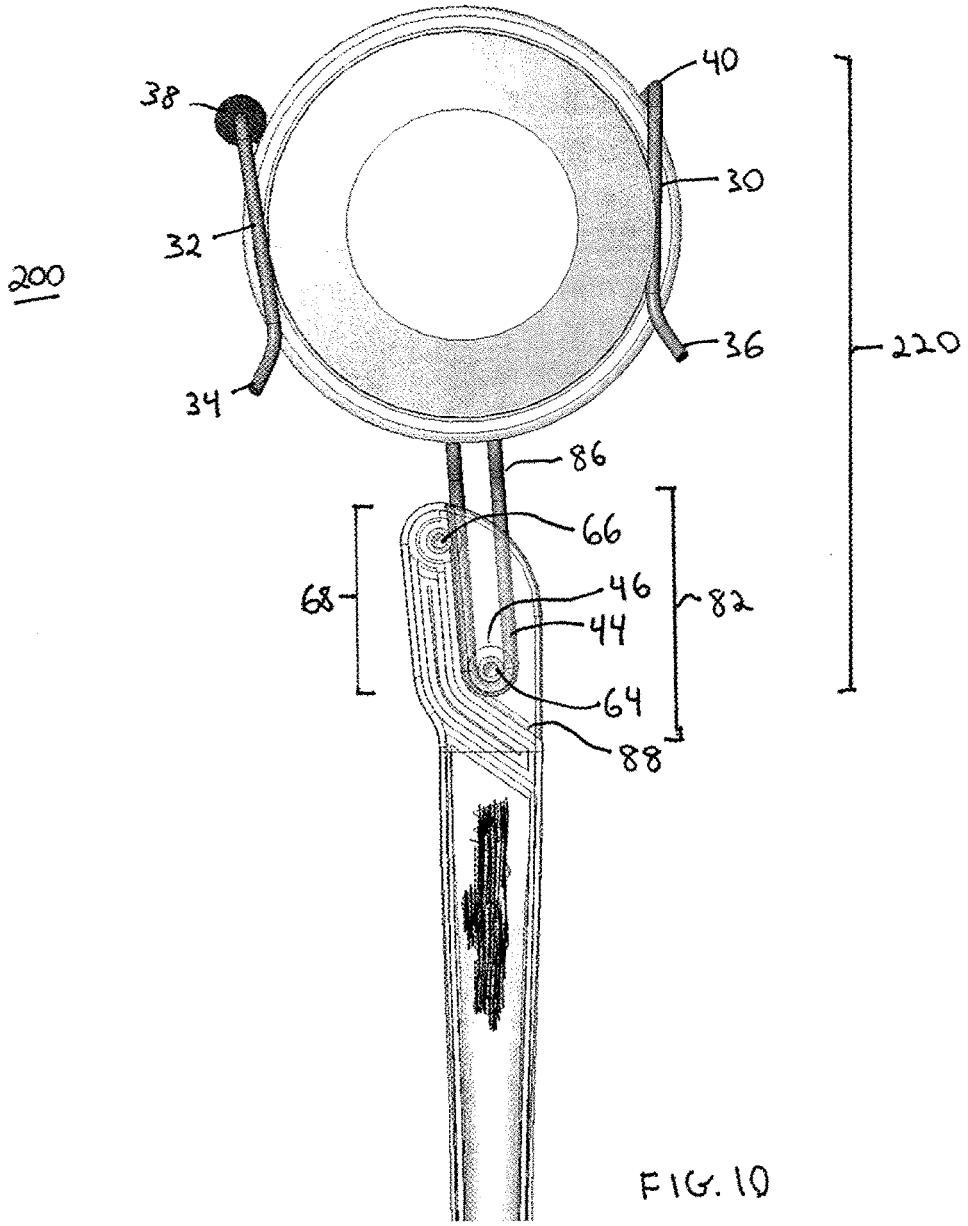
FIG. 10 provides a front elevation view of the embodiment depicted in FIG. 9 with an interior view of the pivot point, including the rotation block component and the impact structure.
Figure 11:
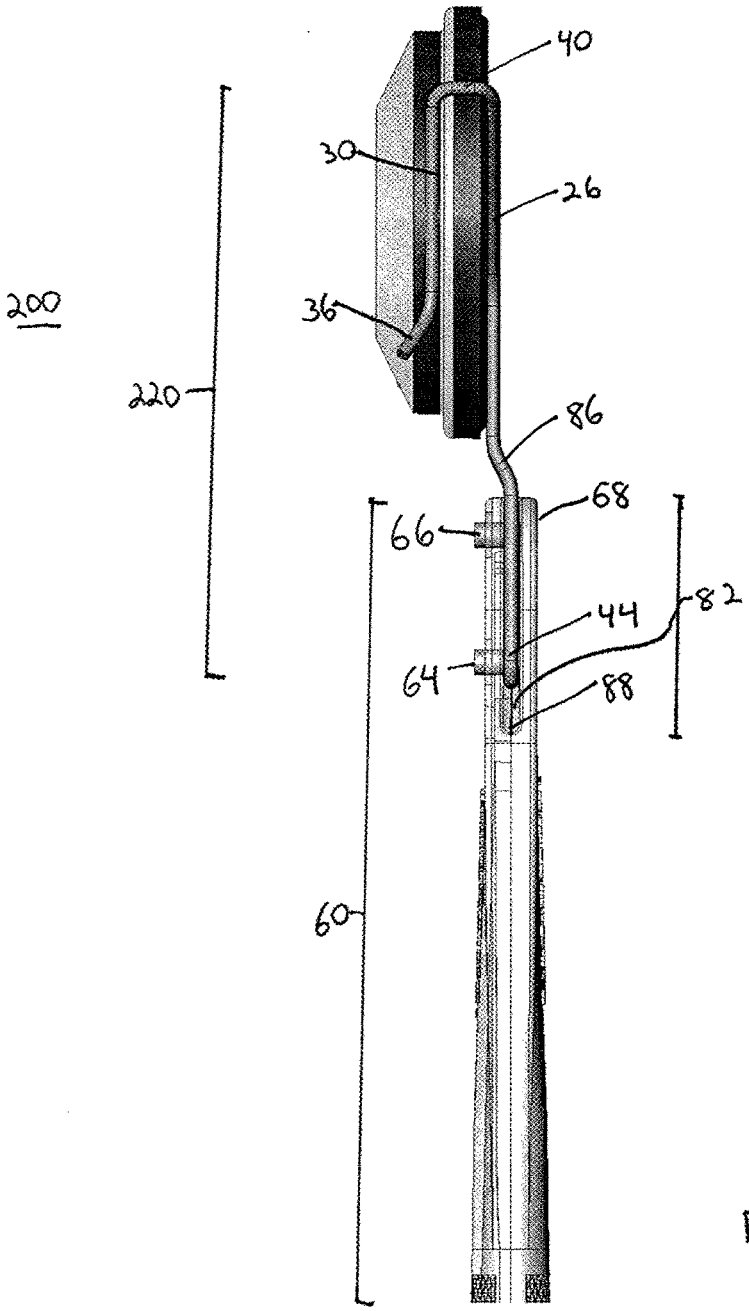
FIG. 11 provides a side elevation view of the embodiment depicted in FIGS. 9, 10, and 12 with an interior view of the pivot point, including the rotation block component and the impact structure.
Figure 12:
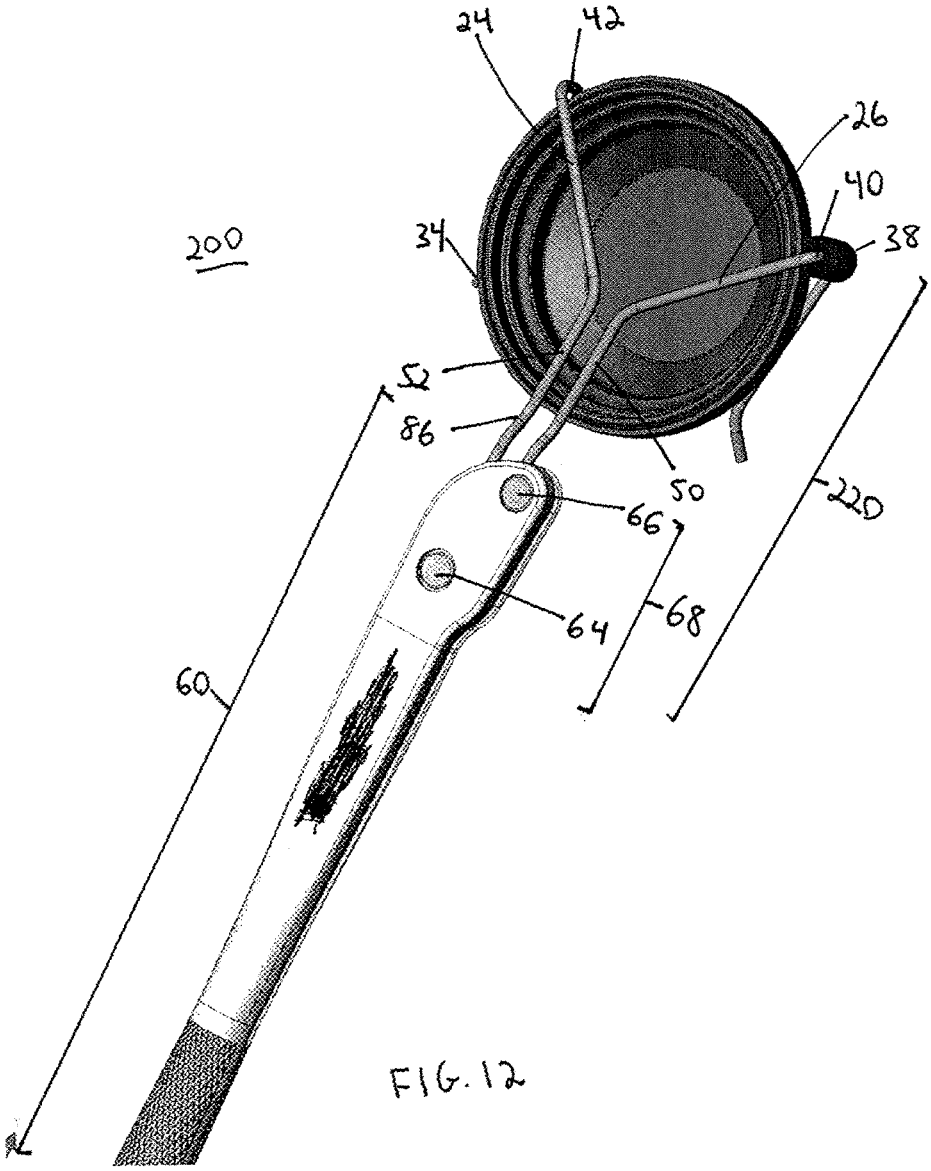
FIG. 12 provides a back perspective view of the embodiment depicted in FIGS. 9-11 with an interior view of the pivot point, including the rotation block component and the impact structure.

FIG. 10 provides a front elevation view of the embodiment 200 depicted in FIGS. 9, 11, and 12 with an interior view of the pivot point, including the rotation block component 88 and the impact backstop structure 68, including a contact means (such as a bolt and nut, or rivet) 66 that serves as part of the handle impact backstop structure 68. Apart from differences in the wire headend 220 as described and depicted in FIGS. 9, 11, and 12, the clay target thrower 200 is similar to the device depicted in FIGS. 1-8 and the descriptions for the shared reference numbers provided for FIGS. 1-8 are incorporated herein by reference.

FIG. 11 provides a side elevation view of the embodiment 200 depicted in FIGS. 9, 10, and 12 with an interior view of the pivot point, including the rotation block component 88 and the impact backstop structure 68, including a contact means (such as a bolt and nut, or rivet) 66 that serves as part of the handle impact backstop structure. The off-set bend 86 to further facilitate easy rear-loading of the headend 220 by moving the headend 220 away from any obstruction imposed by the handle 60 is also shown. The off-set bend 86 is shown to elevate the loading surface to a horizontal plane that is approximately equal to the top surface of the handle 60. Apart from differences in the wire headend 220 as described and depicted in FIGS. 9, 11, and 12, the clay target thrower 200 is similar to the device depicted in FIGS. 1-8 and the descriptions for the shared reference numbers provided for FIGS. 1-8 are incorporated herein by reference.

FIG. 12 provides a back perspective view of the embodiment depicted in FIGS. 9-11, including the rotation block component and the impact backstop structure 68, including a contact means (such as a bolt and nut, or rivet) 66 that serves as part of the handle impact backstop structure 68. The wire headend 220 additionally includes wire length 50 (of wire portion 24) and wire length 52 (of wire portion 26) which each extend outward from the off-set bend 86 in a straight length before extending outwards laterally in a "V-shape." That is, the shape of the second (lower) horizontal plane may be referred to as "V-shaped" and includes two straight wire extensions. The "V-shaped" portion of the second (lower) horizontal plane has an internal angle between the two lines extending out from the common axis of the "V" of about 88 degrees. Apart from differences in the wire headend as described and depicted in FIGS. 9-11, the clay target thrower 200 is similar to the device depicted in FIGS. 1-8 and the descriptions for the shared reference numbers provided for FIGS. 1-8 are incorporated herein by reference.

Figure 13:
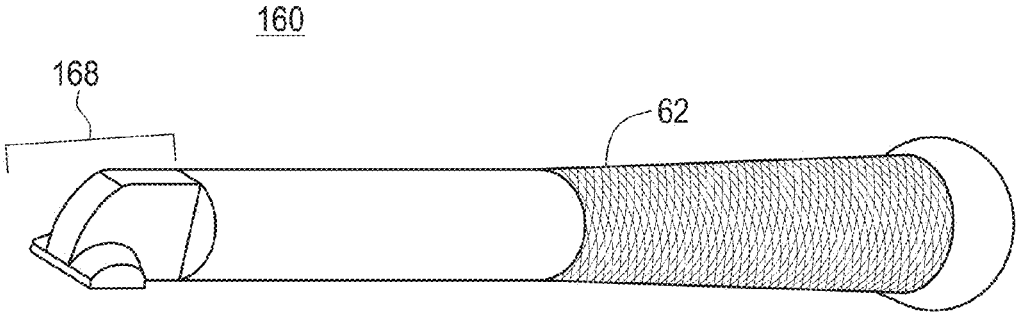
FIG. 13 provides a side perspective view of another handle embodiment according to the present invention.

FIG. 13 provides a side perspective view of an alternative handle embodiment according to the present invention. As depicted, the handle 160 is round and cross-hatched 62 for non-slip gripping and is about 1 inch in diameter, and has a length of about 12 inches (1 foot). It is constructed of a high impact and light weight polymer material and is ergonomically designed for throwing variations. The handle includes an alternative design for the impact backstop structure 168 which comprises the upper end of handle 160.

Figure 14:
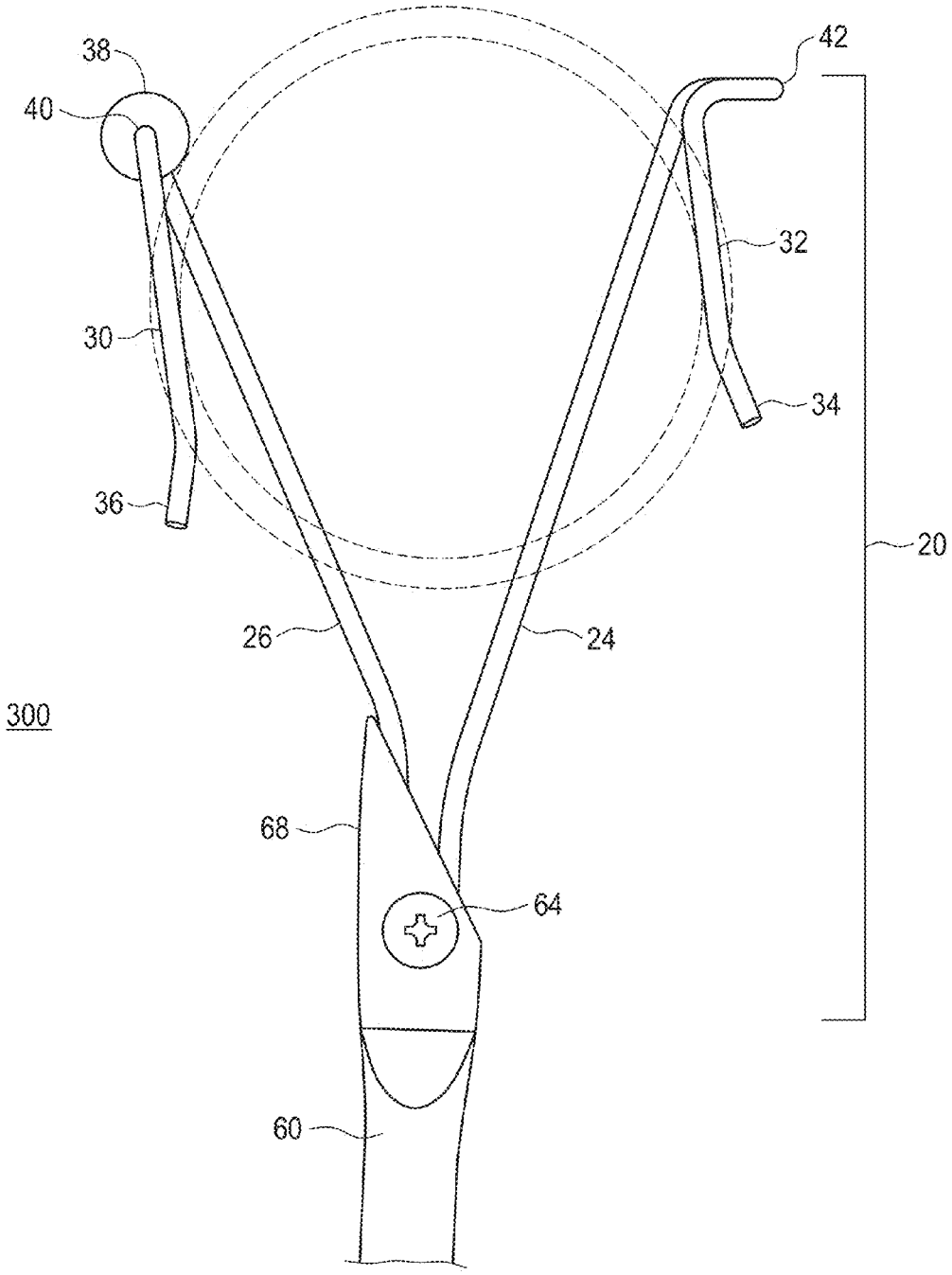
FIG. 14 provides a top elevation view of a clay target thrower according to the present invention.

FIG. 14 provides a top elevation view of an alternative embodiment of a clay target thrower 300 according to the present invention. FIG. 14 depicts headend 20 substantially as presented in FIG. 5. FIG. 14, however, depicts the headend connected to an alternative embodiment of handle 60. As depicted, the handle includes a single connection means (such as a bolt and nut, or rivet) 64 and impact backstop structure 68 is integrally formed as part of handle 60. Apart from differences in the impact backstop structure 68, the clay target thrower 300 is similar to the device depicted in FIGS. 1-8 and the descriptions for the shared reference numbers provided for FIGS. 1-8 are incorporated herein by reference.

While the inventors have disclosed the preferred embodiments of their clay target thrower invention, they do not confine themselves to any particular form of the flexible wire headend to grip the clay target, and the flexible wire headend may be bent in any desired manner to form a flexible grip to secure a clay target. Additionally, the handle may take on various forms without deviating from the spirit of this invention.

The invention claimed is:

1. A clay target thrower comprising:

a single rear-loading wire headend;

a pivot point; and a handle comprising an impact structure and a rotation block component.

2. The clay target thrower of claim 1, wherein the rear-loading wire headend includes a fixed rubber grommet.

3. The clay target thrower of claim 1, wherein the pivot point permits the rear-loading wire headend to rotate a fixed radius selected between about 30 degrees and 165 degrees from the rotation block component to the impact structure.

4. The clay target thrower of claim 3, wherein the pivot point permits the rear-loading wire headend to rotate a fixed radius of 135 degrees from the rotation block component to the impact structure.

5. The clay target thrower of claim 1, wherein the impact structure comprises a rivet.

6. The clay target thrower of claim 1, wherein the rear-loading wire headend is sufficiently stiff to accommodate secure loading of a clay target and sufficiently flexible to permit deflection and launch of a clay target.

7. The clay target thrower of claim 1, wherein a top surface of the rear-loading wire headend secures a loaded clay target via contact with a shoulder surface on a top surface of the loaded clay target.

8. The clay target thrower of claim 1, wherein the rear-loading wire headend spatially occupies a first horizontal plane and a second horizontal plane connected by two separate left and right vertical connection bends.

9. The clay target thrower of claim 1, wherein the second horizontal plane of the rear-loading wire headend is substantially V-shaped.

10. The clay target thrower of claim 1, wherein the rear-loading wire headend includes an attachment point bend partially enclosing an open space.

11. The clay target thrower of claim 1, wherein the handle is round.

12. The clay target thrower of claim 11, wherein the handle comprises a first component and a second component.

13. The clay target thrower of claim 12, wherein the first component and the second component comprise a polymeric material.

14. The clay target thrower of claim 13, wherein the first component and the second component are adhered together.

15. The clay target thrower of claim 1, wherein the handle is hollow.

* * * * *